US007453404B2

(12) United States Patent
Ying

(10) Patent No.: US 7,453,404 B2
(45) Date of Patent: Nov. 18, 2008

(54) ANTENNA DEVICE FOR COMMUNICATION EQUIPMENT

(75) Inventor: Zhinong Ying, Lund (SE)

(73) Assignee: Sony Ericsson Mobile Communications AB, Lund (SE)

( * ) Notice: Subject to any disclaimer, the term of this patent is extended or adjusted under 35 U.S.C. 154(b) by 42 days.

(21) Appl. No.: 10/554,016

(22) PCT Filed: Mar. 4, 2004

(86) PCT No.: PCT/EP2004/002188

§ 371 (c)(1),
(2), (4) Date: Oct. 2, 2006

(87) PCT Pub. No.: WO2004/097977

PCT Pub. Date: Nov. 11, 2004

(65) Prior Publication Data

US 2007/0080871 A1 Apr. 12, 2007

Related U.S. Application Data

(60) Provisional application No. 60/466,309, filed on Apr. 29, 2003.

(30) Foreign Application Priority Data

Apr. 26, 2003 (EP) ..... 03009488

(51) Int. Cl.
*H01Q 1/24* (2006.01)

(52) U.S. Cl. ..... 343/702; 343/700 MS

(58) Field of Classification Search ..... 343/702, 343/700 MS, 906
See application file for complete search history.

(56) References Cited

U.S. PATENT DOCUMENTS

| | | | | |
|---|---|---|---|---|
| 5,918,163 | A | 6/1999 | Rossi | 455/558 |
| 6,166,694 | A | 12/2000 | Ying | 343/702 |
| 6,259,418 | B1 | 7/2001 | Jones et al. | 343/846 |
| 6,456,245 | B1 | 9/2002 | Crawford | 343/702 |
| 6,509,876 | B1 | 1/2003 | Jones et al. | 343/702 |
| 6,758,689 | B1 | 7/2004 | Bair et al. | 439/136 |
| 6,762,725 | B2 | 7/2004 | Beard et al. | 343/702 |

FOREIGN PATENT DOCUMENTS

| | | |
|---|---|---|
| EP | 0954054 A1 | 3/1999 |
| WO | WO 98/27617 | 6/1998 |
| WO | WO99/17398 | 4/1999 |

OTHER PUBLICATIONS

International Search Report dated Aug. 31, 2004, corresponding to PCT Application No. PCT/EP2004/002188.

*Primary Examiner*—Tan Ho
(74) *Attorney, Agent, or Firm*—Myers Bigel Sibley & Sajovec

(57) ABSTRACT

An antenna device for a computer card device, such as a PCMCIA type card, includes at least a first antenna including a trace on a support element, antenna output means, and a protruding member extending from a housing of the card. The support element, which may include a flexible dielectric film, has a geometric shape that is conformed to the geometric shape of the protruding member.

17 Claims, 3 Drawing Sheets

ANTENNA DEVICE FOR COMMUNICATION EQUIPMENT

RELATED APPLICATIONS

The present application is a 35 U.S.C. §371 national phase application of PCT International Application No. PCT/EP2004/002188, having an international filing date of Mar. 4, 2004 and claiming priority to European Patent Application No. 03009488.2, filed Apr. 26, 2003 and United States Provisional Application No. 60/466,309 filed Apr. 29, 2003, the disclosures of which are incorporated herein by reference in their entireties. The above PCT International Application was published in the English language and has International Publication No. WO 2004/097977.

TECHNICAL FIELD OF THE INVENTION

The present invention relates generally to an antenna for a card device. More particularly, the invention relates to an antenna device having a pattern of conductive material for establishing a wireless communication link.

DESCRIPTION OF RELATED ART

Computers are utilized for accessing different communication networks, such as a Local Area Network (LAN), a Wireless Local Area Network (W-LAN), a Wide Area Network (WAN), and/or a telecommunication network. Conventionally, a connection has been established through a wire-based connection, such as a serial cable. It is increasingly common that a computer is provided with a card slot, in which interchangeable computer cards may be inserted. Standards for such PC cards are provided by the Personal Computer Memory Card International Association (PCMCIA). PCMCIA standards specify spatial size restrictions and coupling interface restrictions for computer cards that embody peripheral devices, such as network interface cards. The PCMCIA standards enable a computer user to selectively use a first peripheral device and later remove it when it is no longer needed. This is particularly useful because it allows the computer user to change to another peripheral device based on particular needs. A computer user may e.g. first access data stored on an auxiliary memory card and later exchange the memory card for a network interface card to access a LAN.

The network interface card may be provided with a wireless interface for accessing a communication network. A computer card having a wireless interface requires some sort of antenna. Antennas known in the art are external antennas attached to the housing of the card. This is a problem as the external antennas often are bulky. The external antennas are sometimes detachable to provide a less bulky card during storage and when not in operation. This causes a problem in that the user has to keep track of two separate items, the card and the antenna.

A further problem with the known cards is that the bulky antennas make them inconvenient to insert and retract from a card slot of a computer. The geometrical shape of the card device is limited by the external antenna.

The external antenna may be provided as a foldable whip antenna. However, there is a problem with a foldable antenna as its position during operation may be displaced, which may cause performance degradation.

U.S. Pat. No. 6,329,962 discloses a multiple band antenna having multiple branches. Each branch can be formed by a flexible film, which has a meandering, outer spiral or inner spiral strip line pattern formed thereon. Each branch can also be formed by etching a strip line to a member of a desired shape.

SUMMARY OF THE INVENTION

It is a first object of the invention to provide an antenna device for communication equipment, such as a card device for a computer, which is not bulky in operation.

It is a second object of the invention to provide an antenna device having an antenna, which provides for great design flexibility of the housing of the communication equipment.

A third object of the invention is to provide an antenna device having a nice design and low cost of manufacturing.

The above objects are achieved by an antenna device for a portable communication equipment having a housing, comprising: at least a first antenna arranged on a support element, and antenna output means. The geometric shape of the support element is conformed to the geometric shape of a protruding member of the housing. Moreover, the geometric shape of the support element may be conformed to the geometric shape of an inner surface of the protruding member.

The antenna device may comprise at least a second antenna arranged on the support element. The first or the second antenna may be formed as printed traces of conductive material on the support element.

The support element may comprise a flexible dielectric film. Alternatively, the support element may be an inner surface of the protruding member.

The first antenna may be a multiple branch antenna. The second antenna may be a diversity antenna having first and second monopole antenna branches provided with a mutual distance of at least a quarter of a wavelength of the signal for which the second antenna is adapted. The first antenna may be tuned to a predetermined first frequency and the second antenna may be tuned to a predetermined second frequency. More specifically, the first antenna may be adapted for communication in a GSM frequency band, a DCS frequency band, a PCS frequency band, and/or a UMTS frequency band. The second antenna may be adapted for communication in a W-LAN frequency band.

Another object of the invention is to use the inventive antenna device in a communication apparatus having a design for easy operation, such as insertion and retraction into/out from a card slot.

This object is achieved by using the inventive antenna device in a portable communication equipment. The portable communication equipment may be a computer card device for providing wireless data communication.

One advantage of the present invention is that the antenna device provides great flexibility for the geometric shape of the housing of the card device. Also, a user of the card does not have to take any bulky external antenna into consideration.

Furthermore, it is an advantage that the antenna device can be integrated within the housing of the card device, specifically in the protruding member. Incorporating the antenna device into the protruding member may provide two functions in one structural means, a handle means and an antenna.

Further embodiments of the invention are defined in the dependent claims.

It should be emphasized that the term "comprises/comprising" when used in this specification is taken to specify the presence of stated features, integers, steps or components but does not preclude the presence or addition of one or more other features, integers, steps, components or groups thereof.

BRIEF DESCRIPTION OF THE DRAWINGS

Further objects, features, and advantages of the invention will appear from the following description of several embodiments of the invention, wherein various aspects of the invention will be described in more detail with reference to the accompanying drawings, in which.

DETAILED DESCRIPTION OF EMBODIMENTS

Figure 1:
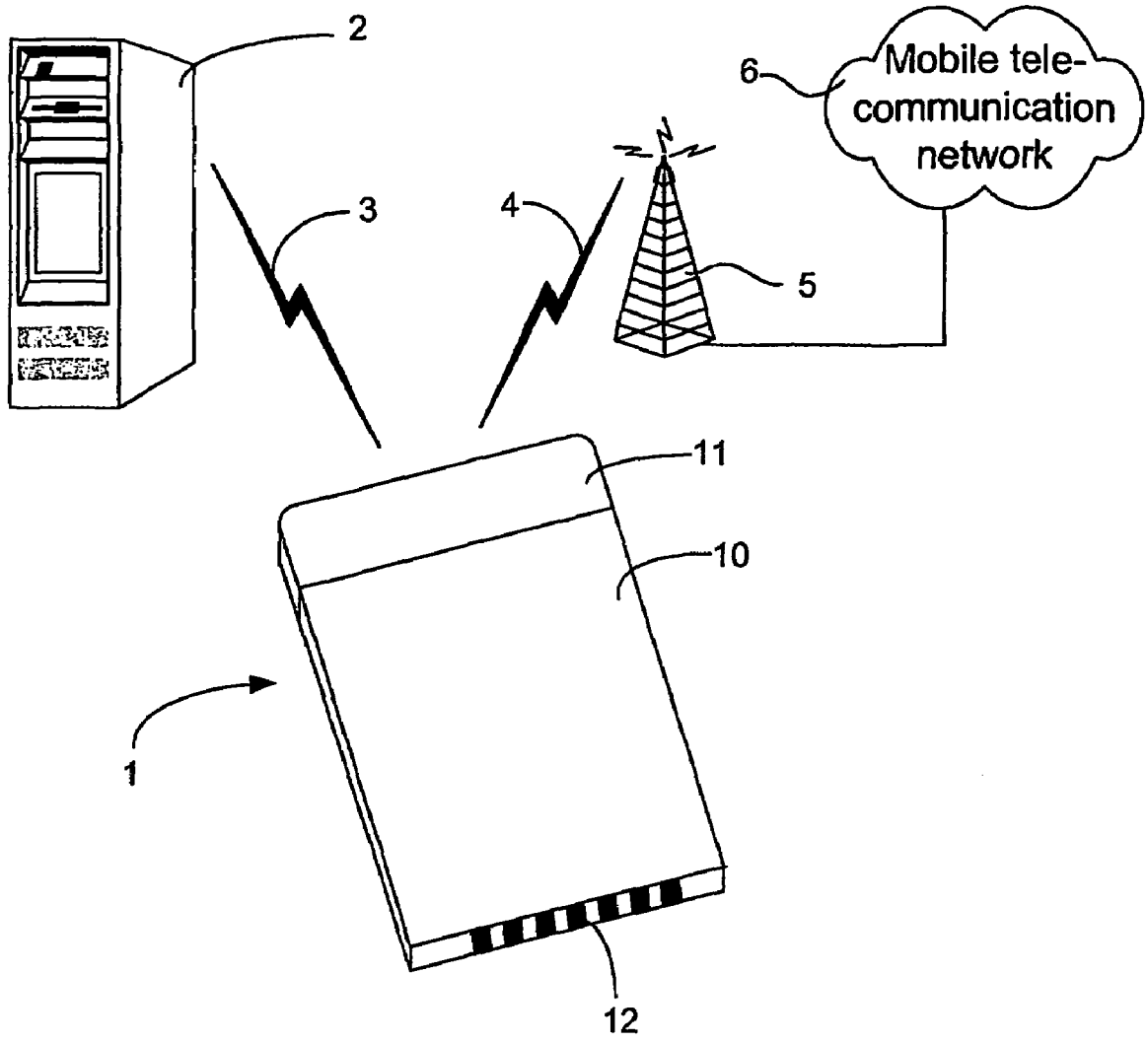
FIG. 1 is a schematic perspective view of a computer card device having a protruding member comprising an antenna device according to the invention, as well as an example of an environment in which it may operate.

FIG. 1 illustrates a computer card device 1 having computer module dimensions, such as a PCMCIA (Personal Computer Memory Card International Association) compute card device. The card device 1 is capable of establishing a communication link with a server 2 of a W-LAN (Wireless Local Area Network), via a first wireless link 3. The card device 1 may also establish a second wireless link 4 with a radio station (base station) 5 in a mobile telecommunication network 6, such as a GSM, DCS, PCS, UMTS and/or cdma2000 network.

The card device comprises a housing 10 having an integrated protruding member 11 for providing e.g. a handle means. The protruding member 11 provides easy operation for inserting and retracting the card device 1 into/out from a mating card slot of an electronic apparatus, such as a desk top computer or a laptop computer, having a PCMCIA card slot. At one end of the housing 10, preferably at the opposite end of the protruding member 11, is a connector interface 12 provided. The interface 12 will mate with a connector interface of a corresponding card device slot extending into the interior of the electronic apparatus when the card device 1 is inserted therein. The card device 1 is adapted to communicate data with the apparatus it is inserted in.

Figure 2A:
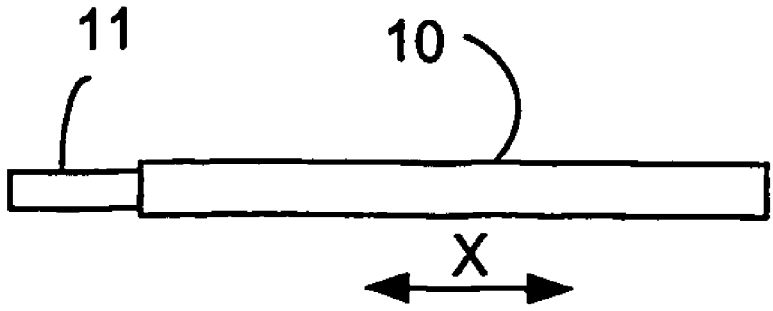
FIGS. 2*a-c* are side views of the card device, which show alternative embodiments of the geometrical shape of the protruding member.
Figure 2B:
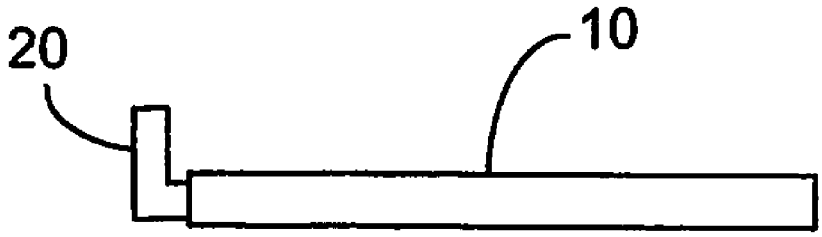
Figure 2C:
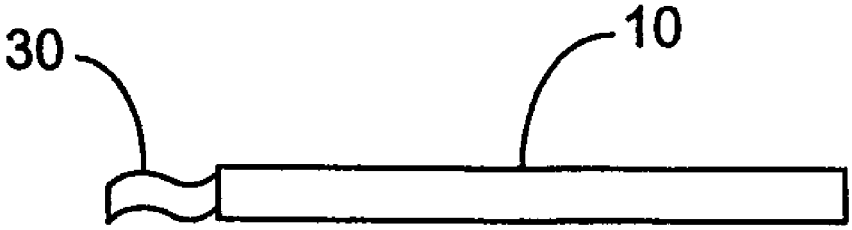

In FIGS. 2*a-c*, different embodiments of the protruding member 11 are illustrated. FIG. 2*a* is a side view of the card device of FIG. 1, wherein the protruding member 11 extends in the direction of insertion and retraction (X) of the card device 1 into the card slot of the electronic equipment. The protruding member 11 may be made of a rubber material, which is connected to the housing 10. Alternatively, the protruding member 11 is provided in the same material as the housing 10, and is an extension of the housing 10, with which it forms an integral unit. The housing 10 may be made of a plastic or rubber material.

The angle of the protruding member 11 relatively to the housing 11 is not limited to the direction of insertion and retraction (X), as is indicated with a L-shaped protruding member 20 in FIG. 2*b*. The angle of the protruding member 11 relatively to the housing 10 and the direction of insertion and retraction X may be in the range of +/−90 degrees.

FIG. 2*c* is a side view of a third embodiment of the card device 1 having a corrugated protruding member 30. The corrugated protruding member 30 may be provided according to the same principles as the protruding members 11, 20 of FIGS. 1-2. Consequently, the corrugated protruding member 30 may be provided in different angles with respect to the housing 10.

The geometric shape of the protruding member 11, 20, 30 is not limited to the shown embodiments. Said shape may be varied in a number of ways for providing a protruding member that provides an efficient and convenient means for inserting/retracting the card device 1 into/from the card slot of the computer. Furthermore, the shape may vary due to design considerations, such as radiation characteristics.

Figure 3:
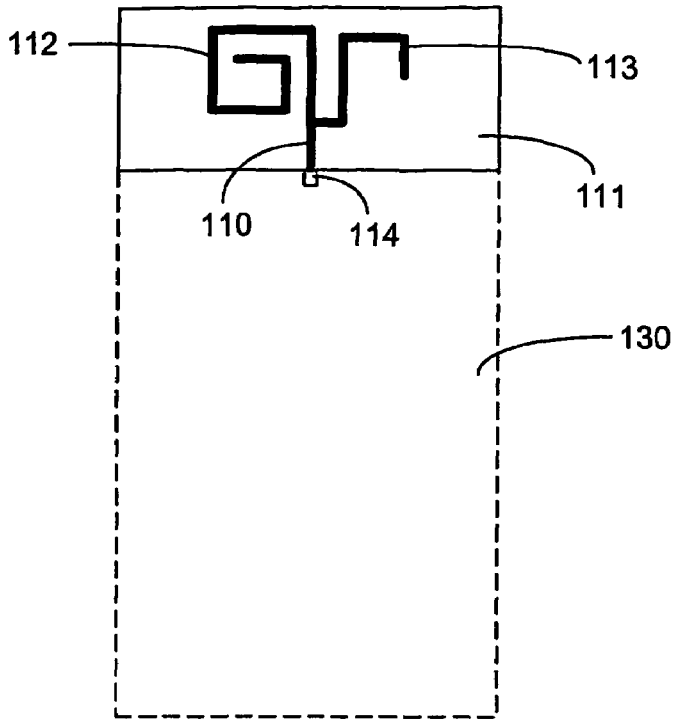
FIG. 3 is a front view of a first embodiment of the antenna device according to the invention.

FIG. 3 illustrates a first embodiment of the antenna device according to the present invention. The antenna device comprises at least a first antenna 110 formed as a trace of conducting material on a support element 111. The first antenna is a multi band branch antenna comprising a first and a second branch 112, 113 formed by strips of conducting material. The length of the branches 112, 113 is selected so as to allow said multiple branch antenna 110 to be tuned to multiple resonance frequencies at first and second frequency bands. The first band may be the GSM 900 MHz frequency band and the second band may be the GSM 1800/1900 GSM frequency band. The length of the first branch is approximately ¼ wavelength of a GSM 900 MHz signal, and the second branch is approximately a ¼ wavelength of a GSM 1800/1900 MHz signal. Alternatively either of the bands may be the DCS, PCS or the UMTS frequency band.

The first and the second branches 112, 113 are connected to each other. The first antenna 110 comprises a terminal 114 for exchanging signals with receiver/transmitter circuitry within the card device 1. The first branch 112 is an outer spiral branch strip, which resonates at first frequencies. The second branch 113 is a meandering branch, which resonates at second frequencies. Alternatively, the branches are formed as inner spiral branches. A variety of different patterns for the branches 112, 113, and possibly additional branches when appropriate, could be selected to achieve the desired resonance frequencies. The shown embodiments are only for exemplifying purposes and are not intended to limit the scope of the invention.

Figure 4:
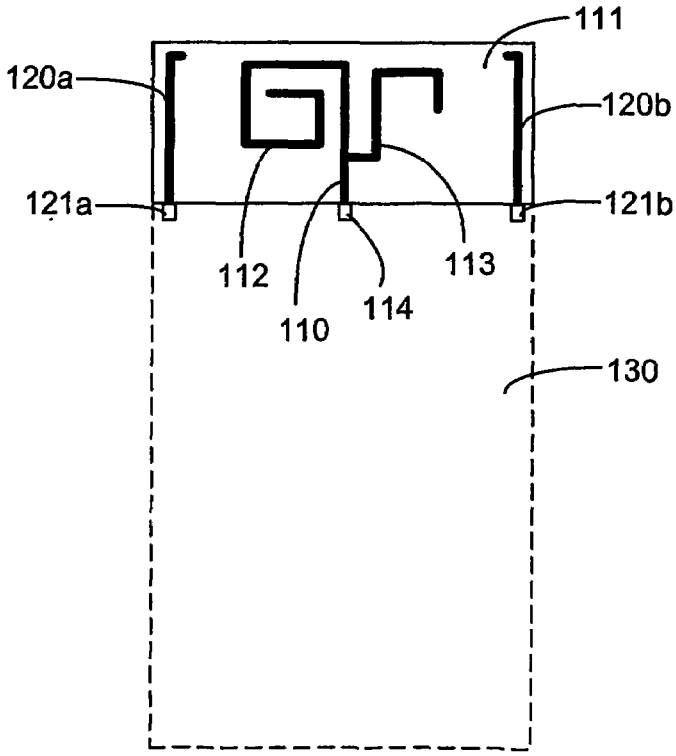
FIG. 4 is a front view of a second embodiment of the antenna device according to the invention.

FIG. 4 illustrates a second embodiment of the antenna device according to the invention, comprising the first antenna 110 of FIG. 3 and a second antenna 120*a-b*. The second antenna comprises first and second printed meander monopole antenna branches 120*a-b* of strips of conducting material provided on the support element 111. The monopole antenna branches 120*a-b* are physically separated to provide spatial diversity. The distance between the monopole antenna branches 120*a-b* is preferably at least ¼ wavelength of the signal for which said antenna is adapted. With appropriate physical distance between the first and second monopole antenna branch 120*a-b* a correlation coefficient below 0.1 is achieved, which provides a good diversity gain. The length of each of the monopole antenna branches 120*a-b* are selected so as to allow said antenna 120,*a-b* to be tuned to a resonance frequency band different than the frequency bands of the first antenna 110. The frequency band of the monopole antenna is e.g. a W-LAN 2.4 GHz frequency band. The first and second monopole antenna branch 120*a-b* have first and second terminals 121*a-b*, respectively, for exchanging signals with the transmitter/receiver circuitry within the card device 1.

The pattern of the second antenna is not limited to meander monopole antennas. The second antenna may be provided as meander antennas or PIFA (Planar Inverted F Antenna) antennas. Also, it is not necessary or required that the second antenna 120*a-b* is a diversity antenna.

The terminals 114, 121*a-b* may be directly connected to the circuitry of the card device 1, which may be provided on a PCB (Printed Circuit Board) 130, by a number of different connection techniques, such as by soldering directly to the PCB 130, by pogo-pins, or leaf spring contacts.

If the impedance of the antennas is matched to the circuitry of the PCB 130, such as having an impedance of 5 ohm, no antenna matching circuitry is needed and the antenna device may be directly connected to the circuitry of the card device 1.

The antenna device comprises the support element 111, upon which the first and second antennas 110, 120*a-b* are provided. In one embodiment of the invention, the support element 111 is a flexible dielectric film. Suitable film materials are commercially available from Rogers Corporation, Advanced Circuit Materials Division, 100 N Dobson Road, Chandler, Ariz. -85224, USA, or alternatively from Freudenberg Mectec GmbH, Headquarters, D-69465 Weinheim/bergstrasse, Germany. Such flexible dielectric films are utterly thin. The typical thickness ranges are from about 70 μm to about 400 μm.

Thus, the thickness of the protruding member 11 may also be thin, and is essentially limited by the preferred thickness of said member 11. In the embodiment of FIGS. 4 and 5, the length of the film is approximately 15 mm. Or lengths may be provided, and is dependent of the actual shape of the antenna branches. The flexible dielectric film may be provided with an adhesive for fastening said film to an inner surface of the protruding member 11. Because the film is flexible, it can take a wide range of different geometric shapes. The shapes may conform to the geometric shape of the inner surface of the protruding member 11, depending upon design considerations.

The protruding member 11 may be provided with two separate connectable portions having a cavity there between. The flexible film may be adhered to at least one of the inner surfaces of said portions. Alternatively, said film is provided on an outer surface of the protruding member 11 and may be covered by a protective layer. The protruding member 11 may alternatively be provided as a single unit comprising the flexible film.

The conductive strips of the antennas 110, 120*a-b* may be formed on the support element 111 by printing, etching, carving, soldering or any other suitable method.

Alternatively, the conductive strips of the antennas 110, 120*a-b* may be formed directly on an inner surface of the protruding member 11 forming the support element 111. The strips may be provided by e.g. an electroplating technique or a MID (Mould-Interconnect-Device) production technique, wherein the conductive material is selectively provided directly on the support element 111.

The housing 10 and the protruding member 11 may be provided using a injection-moulding technique, followed by a laser activation of metallic seeds on the inner surface of the protruding member 11. Finally, the surface having the seeds is immersed into a metallization bath, wherein a conductive pattern of e.g. Cu, Ni, Au etc. may be formed. By forming the conductive pattern directly within the protruding member 11, the geometric shape of the antenna has an excellent conformance to the geometric shape of inner surface of the protruding member 11.

The support element 111 may still alternatively comprise a PCB, which may form part of the PCB 130 of the card device 1. The geometric shape of the protruding member 11 is then adapted to the geometric shape of the PCB, which in general will be elongated in the direction of insertion and retraction X into the card slot. Alternatively, the PCB is a flexible PCB, which may be conformed to the geometrical shape of the protruding member 11.

When the card device 1 is inserted into a card slot, the protruding member 11 will protrude from said slot. Thus, it is desired to provide the antenna device within the protruding member 11 to provide good radiation characteristics. The antenna device may be provided as an integral part of the housing 10, and preferably within the protruding member 11.

The present invention has been described above with reference to specific embodiments. However, other embodiments than the above described are equally possible within the scope of the invention. The different features of the invention may be combined in other combinations than those described. The invention is only limited by the appended patent claims.

The invention claimed is:

1. A card device configured for insertion in a computer, comprising:

a housing;

at least a first antenna arranged on a support element coupled to the housing, wherein both the first antenna and the support element are arranged within the housing, and wherein the antenna comprises a conductive strip on the support element; and antenna output means coupled to the antenna;

wherein the housing comprises a protruding member that protrudes from the computer and that has an irregular shape including at least one portion that is angled relative to the housing; and wherein a geometric shape of the support element is conformed to the irregular shape of the protruding member of the housing including the at least one portion that is angled relative to the housing so that the conductive strip of the antenna is likewise conformed to the irregular shape of the protruding member of the housing.

2. The device according to claim 1, wherein the antenna output means is directly connected to circuitry arranged in the housing.

3. The device according to claim 2, wherein the circuitry is provided on a printed circuit board in the housing.

4. The device according to claim 1, wherein the geometric shape of the support element is conformed to a geometric shape of an inner surface of the protruding member.

5. The device according to claim 1, wherein the at least a first antenna comprises printed traces of a conductive material on the support element.

6. The device according to claim 1, wherein the support element comprises a flexible dielectric film.

7. The device according to claim 1, wherein the support element comprises an inner surface of the protruding member.

8. The device according to claim 1, wherein the at least a first antenna comprises a multiple branch antenna.

9. The device according to claim 1, wherein the at least a first antenna is adapted for communication in a GSM frequency band, a DCS frequency band, a PCS frequency band, and/or a UMTS frequency band.

10. The device according to claim 1, further comprising at least a second antenna arranged on the support element.

11. The device according to claim 10, wherein the second antenna comprises printed traces of a conductive material on the support element.

12. A card device configured for insertion in a computer, comprising:

a housing;

at least a first antenna arranged on a support element coupled to the housing; and antenna output means coupled to the antenna;

wherein the housing comprises a protruding member having an irregular shape; and wherein a geometric shape of the support element is conformed to the irregular shape of the protruding member of the housing, wherein the irregular shape of the protruding member is L-shaped and/or corrugated.

13. A card device configured for insertion in a computer, comprising:

a housing;

at least a first antenna arranged on a support element coupled to the housing; and antenna output means coupled to the antenna;

wherein the housing comprises a protruding member having an irregular shape; and wherein a geometric shape of the support element is conformed to the irregular shape of the protruding member of the housing, wherein the protruding member has an angle relative to the housing of about +/−90 degrees.

14. A card device configured for insertion in a computer, comprising:

a housing;

at least a first antenna arranged on a support element coupled to the housing; and antenna output means coupled to the antenna;

wherein the housing comprises a protruding member having an irregular shape; and wherein a geometric shape of the support element is conformed to the irregular shape of the protruding member of the housing, wherein the protruding member comprises a rubber material.

15. A card device configured for insertion in a computer, comprising:

a housing;

at least a first antenna arranged on a support element coupled to the housing; and antenna output means coupled to the antenna;

wherein the housing comprises a protruding member having an irregular shape;

wherein a geometric shape of the support element is conformed to the irregular shape of the protruding member of the housing; and at least a second antenna arranged on the support element, wherein the at least a second antenna comprises a diversity antenna having first and second monopole antenna branches provided with a mutual distance of at least a quarter of a wave length of a signal for which the second antenna is tuned.

16. The device according to claim 15, wherein the at least a second antenna is adapted for communication in a W-LAN frequency band.

17. The device according to claim 15, wherein the at least a first antenna is tuned to a first frequency and the at least a second antenna is tuned to a second frequency.

* * * * *